United States Patent [19]

Van Erden

[11] Patent Number: 4,817,188

[45] Date of Patent: Mar. 28, 1989

[54] BAG WITH SEPARATE ATTACHED ZIPPER AND METHOD OF MAKING

[75] Inventor: Donald L. Van Erden, Wildwood, Ill.

[73] Assignee: Minigrip, Inc., Orangeburg, N.Y.

[21] Appl. No.: 164,970

[22] Filed: Mar. 7, 1988

[51] Int. Cl.[4] ..... B65P 33/16

[52] U.S. Cl. ..... 383/63; 493/215; 24/287

[58] Field of Search ..... 383/63; 493/214, 215; 156/66; 24/587

[56] References Cited

U.S. PATENT DOCUMENTS

| | | | |
|---|---|---|---|
| 3,381,592 | 5/1968 | Rauel | 383/63 |
| 4,430,070 | 2/1984 | Ausnit | 493/215 |
| 4,682,366 | 7/1987 | Ausnit et al. | 24/587 |
| 4,731,911 | 3/1988 | Gould | 24/587 |

FOREIGN PATENT DOCUMENTS

| | | | |
|---|---|---|---|
| 965258 | 7/1964 | United Kingdom | 383/63 |

*Primary Examiner*—Willis Little

*Attorney, Agent, or Firm*—Hill, Van Santen, Steadman & Simpson

[57] ABSTRACT

An improved reclosable bag structure such as formed out of plastic film or laminations thereof with front and back wall panels attached at their bottom and side edges and reclosable rib and groove profile fastener strips along the inner surface of the panels at the bag top with at least one of the strips secured by a layer of bonding element that has a limited area to secure the fastener strip only at its upper edge at a location above the profile or alternatively the strip uses a bond preventing element that permits only the upper edge of said strip to be secured to said panel at a location above the profile with this manner of securing accommodating outward movement of the film panel to apply a force on the strips in a shear rather than a peel mode.

12 Claims, 1 Drawing Sheet

BAG WITH SEPARATE ATTACHED ZIPPER AND METHOD OF MAKING

BACKGROUND OF THE INVENTION

The present invention relates to improvements in plastic film bags with pressure closable releasable rib and groove profile fasteners at the top.

In the development of thin plastic film bags, an objective to be served is to provide a bag which has pressure closable and reopenable continuous rib and groove profile fastener elements at the top. Such fastener elements must securely close the bag and resist accidental opening due to forces on the side walls of the bag which occur during stacking, handling and merchandising. In order to reduce the cost of the bag, the fastener profiles are made as lightweight as possible without jeopardizing the facility of the fasteners to hold the bag closed. The ability of the fastener to remain closed can be augmented by design of a fastener but also by design of the bag structure in relation to the fastener structure. Coaction between the bag wall panels and the fastener strips can be attained by structural design so that stresses and pulls on the bag wall, such as occur inadvertently, do not pull apart the fastener strips to open the rib and groove profile fastener elements.

An object of the invention is to provide an improved bag structure which has a greater resistance to opening wherein the bag is constructed with separate fastener strips attached to the inner wall surface of the panels.

A further object of the present invention is to provide an improved bag stretcher and method of making the same wherein the bag has a reclosable fastener at the top and can withstand pulls and shocks from handling and from the contents without accidental opening of the bag fastener.

A further object of the invention is to provide an improved structure and method of making the structure wherein forces on the wall panel of a flexible bag act in a shear mode on the reclosable fastener rather than on a peel mode.

FEATURES OF THE INVENTION

In accordance with the principles of the invention, a bag structure is provided wherein the bag is formed of a thin plastic film or of laminations of thin materials to provide front and back wall panels attached along their edges with the upper edges separated to provide an opening for filling the bag. In order to accomplish a reopenable and reclosable bag, fastener strips are fabricated and attached to the inner surfaces of the panels at the top. The fastener strips are formed with pressure reclosable releasable rib and groove profiles along the facing surfaces. The strips have the base supporting the profiles and the base of the strips is secured to the inner surface by the bonding element which may be a heat weld joining the plastic of the strips and the wall panels or may be an adhesive. In accordance with the principles of the invention, at least one of the strips is attached with a bonding element only along its upper edge above the center-line of the interlocking profile with the lower portion of said strips unattached. With this structure, the wall panel can move outwardly relative to the fastener strips such as occurs in handling and storage and such as occurs due to the separating force applied by contents within the bag. The outward movement of the wall panel will not apply a direct opening force to the fastener and the bonding element will act as a hinge so that the fastener strips can pivot and forces on the strips will act in a shear mode rather than a peel mode relative to the interlocked rib and groove elements. This form of structure can withstand shock loads or constant force loads such as can occur when the bags are thrown into a carton for packing or when the bag is roughly handled. Similar forces can occur with settling of the contents in a full bag when it is stored or stacked.

Other objects, advantages and features will become more apparent with the teaching of the principles of the invention in connection with the disclosure of the preferred embodiments thereof in the specification, claims and drawings, in which:

DESCRIPTION OF THE PREFERRED EMBODIMENTS

Figure 1:
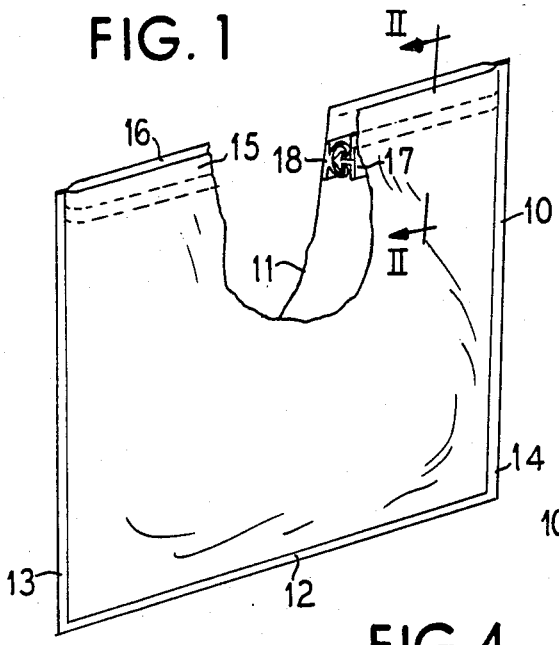
FIG. 1 is perspective view with parts broken away of a bag constructed in accordance with the principles of the present invention.

As illustrated in FIG. 1, a plastic bag is formed with front and rear thin wall panels 10 and 11 which may be of a material such as polyethylene film or laminated layers of film. The panels 10 and 11 are attached along their bottom edge 12 and along their side edges 13 and 14. At the top are projecting flanges 15 and 16. The flanges may be separated at their top edge, as shown in the drawings, or the top edges may be joined for separation when the bag is used. For example, the bag may be formed initially by the top being doubled so that flanges 15 and 16 are part of continuous film. When the top edges of the flanges are joined, the bag will be filled from either the bottom or side and closed after filling by forming the bottom or side seam.

Figure 2:
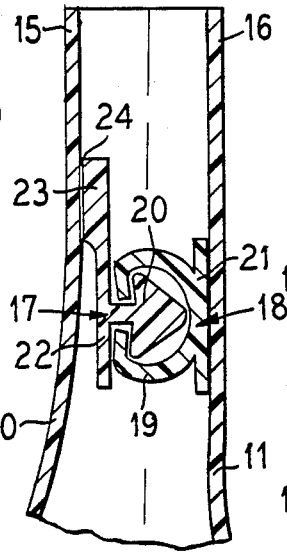
FIG. 2 is a sectional view taken substantially along line II—II of FIG. 1 and enlarged to better illustrate the relative construction between the bag wall panels and the fastener strips.

On the inner surfaces of the panels at the top are fastener strips 17 and 18. The fastener strips are formed separately and are continuous extruded strips having cooperative interlocking rib and groove profiles of the general nature shown by the male rib profile element 17 and the female groove profile element 18 in FIG. 2. The profiles of the strips are interlocking with an arrow shaped head 20 which enters between the jaws of the groove 19. These separately formed strips are attached to the inner surface of the panels 10 and 11 in a unique manner as will be described in connection with FIGS. 1, 2 and 4 in one form, and with FIGS. 3 and 5 in another form. FIGS. 6 and 8 illustrate another mode of manufacture as do FIGS. 7 and 9, with FIG. 10 illustrating the combination of certain other of the forms as will be apparent from the ensuing description.

Referring again to FIGS. 1, 2 and 4, the groove profile fastener strip 18 is attached along its base 21 flat to the inner surface of the panel 11. This may be an attachment by a heat weld along the base or by an adhesive.

The fastener strip 17 is secured by a bonding element 24 which is located at the upper portion of said fastener strip above the center-line of the profile rib 20. The profile 20 has a base 22 and the upper edges of the base may be thickened as at 23 for the layer of bonding element 24 to attach to the inner surface of the panel 10. The bonding element 24 layer may be an adhesive or other bonding material so as to secure the strip 17 to the inner surface of the wall panel 10. With this construction, the fastener strips may be joined by pressing them together so that the profile rib 20 enters the profile groove 19. For separation, the upwardly extending flanges 15 and 16 are pulled apart to open the top of the bag for filling or for reuse. However, during normal handling, when the bag is stacked or stored, the bag will not be inadvertently opened due to pulls on the wall panel.

When the bag is filled and handled or thrown, the wall panels 10 and 11 tend to push outwardly. The bonding element 24 and the upper edge 23 of the base will act as a hinge and the joined fastener strips will pivot so that forces which pull apart the panels 10 and 11 will act on the fastener strips in a shear mode rather than a peel mode. If both strips were attached along their full width along the base, forces against the panels 10 and 11 from the inside of the bag would tend to open the bag from the inside as easily as from the outside. With the structure, forces from the inside will be ineffective to separate the fasteners and the fasteners can be separated from the outside much easier than from the inside.

Figure 3:
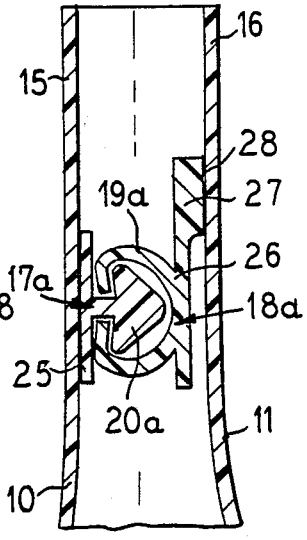
FIG. 3 is a sectional view similar to FIG. 2, but illustrating an alternative form of the invention.
Figure 5:
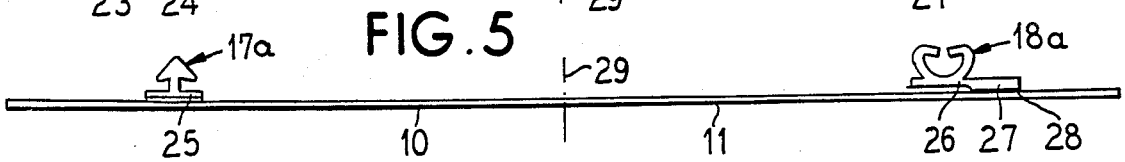
FIG. 5 is a view similar to FIG. 4 and illustrating the panels before forming into a bag employing the arrangement of FIG. 3, whereas FIG. 4 employs the arrangement of FIG. 2.
Figure 6:
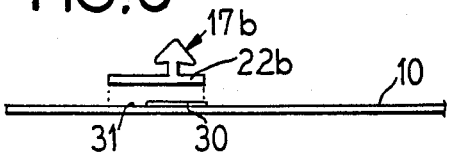
FIG. 6 is an elevational view illustrating one manner of attaching a fastener strip to a wall panel.

In the arrangement shown in FIGS. 3 and 5, a rib profile strip 17*a* having a rib 20*a* is attached along the full width of its base 25 to the wall panel 10. A mating groove fastener strip 18*a* having a groove 19*a* has its base 26 attached only at the upper edge 27 by a bonding element 28. In this structure, the groove strip 18*a* becomes the pivotal member with pivoting occuring at the upper edge 27 of the base when the wall panels 10 and 11 are pushed apart.

Figure 4:
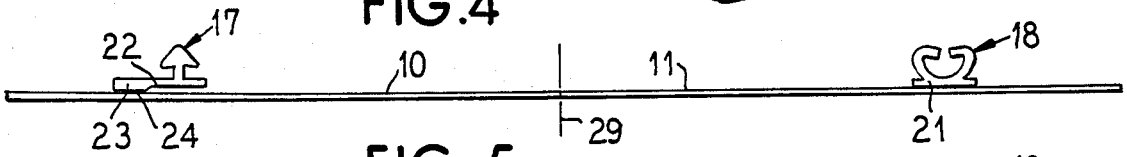
FIG. 4 is an elevational view showing the film of the bag with strips attached prior to forming the panels into the bag.

In accordance with the method of the invention, the separate fastener strips are attached to the wall panels, preferably while the wall panels are laid out flat as illustrated in each of the FIGS. 4 through 7. As illustrated in FIG. 4, the strip 17 is attached such as by heat bonding the base 22 at the portion 23 with the bond at 24. This may be accomplished by an adhesive on the base 22 or on the panel 10.

In the arrangement of FIG. 5, the bonding element 28 may be on the portion 27 of the strip or on the same opposed area of the panel 11. Or, heat may be applied by a heating element to the portion 27 or bonding may be accomplished through heat welding by ultrasonic bonding.

Because of the very small sizes of the fastener strips, an arrangement may be employed in accordance with the principles of the invention whereby bonding is limited to the upper edge of the strip by coating either the strip or the panel with a bonding resistant layer, shown at 30 in FIG. 6. The layer 30 is applied over a controlled area of the panel 10 prior to attachment of a strip 17*b*. When the strip 17*b* is applied by being brought down against the panel, the area 22*b* will not attach to the panel because of the adhesive or bonding resistant layer 30. The area at 31 will adhere, either due to heat welding or to an adhesive, to result in the structure shown in FIG. 2. The adhesive resistant area may be of a material such as a silicone material. If a liquid silicone compound is applied by controlling the viscosity, a controlled area can be applied to the panel such as shown at 30 in FIG. 8. This layer will not only prevent bonding when the strip 17*b* is first applied to the panel, but will prevent inadvertent sticking or bonding if the bags are stacked with a pressure which might tend to cause the plastic of the strip 17*b* to adhere to the panel 10 over the area which is shown as occupied by the material 30.

Figure 7:
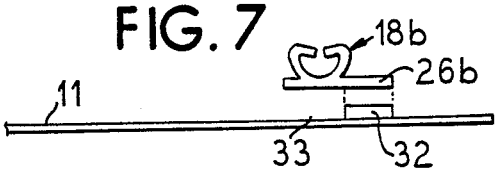
FIG. 7 is an elevational view also illustrating a manner of attaching a fastener strip to a wall panel.
Figure 8:
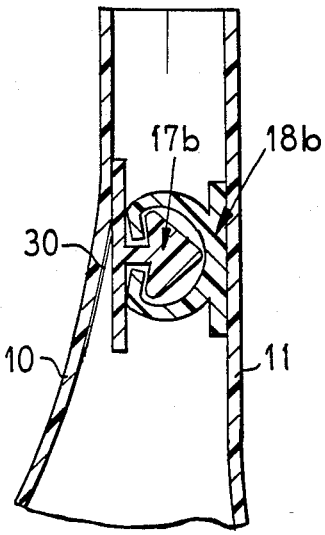
FIGS. 8 through 10 are enlarged fragmentary sectional views of the top end of a bag illustrating three different forms of attachment of the fastener strips to the bag panels.
Figure 9:
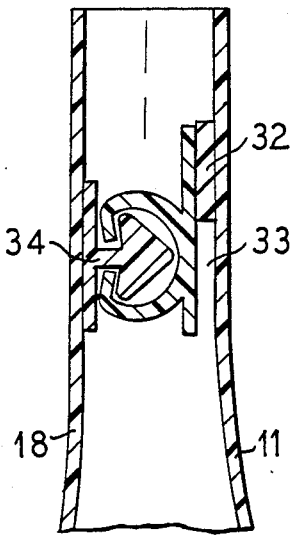
Figure 10:
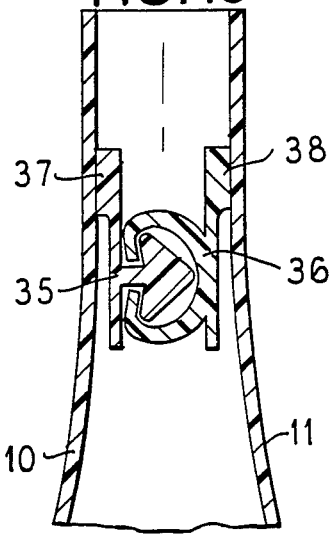

In the arrangement of FIGS. 7 and 9, a bonding promoting strip 32 is used. This bonding promoting material may be necessary where the panel 11 is of an essentially noncompatible nature relative to the material of a fastener strip 18*b*. Also, the limited area strip 32 may be an adhesive material. In any event, when the strip 18*b* is applied, it will adhere to the panel 11 over only the area 26*b* which is defined by the strip 32. The area 33 which is beneath the profile of the strip 18*b* will not attach.

As will be apparent to those versed in the art, the arrangement of the adhesion resistant or preventing strip 30 or the adhesion promoting strip 32 may be used either with the male profile strip 17*b* or the female strip 18*b* or with both, or a combination of both arrangements may be employed.

In FIG. 10 an arrangement is shown wherein both fastener strips 35 and 36 are adhered only along the top edges 37 and 38 respectively of their base.

In operation, in accordance with the method, a sheet or web of film material is provided which will furnish the wall panels 10 and 11 of the bag. Separately extruded fastener strips 17 and 18 are provided with at least one of the strips bonded to the inner surface of the wall panel film only along its upper edge. Such bonding will occur either by having a narrow strip of bonding element material at the location where the upper edge of the strip is to be attached or by providing a bonding preventing material strip, such as shown at 30 in FIG. 6, in the area opposite the profile. The other fastener strip may be similarly formed, but preferably is attached along its full base, such as shown in FIG. 4, and the panels 10 and 11 are brought together to form either a fold 12 at the bottom of the bag or a seam and side seams 13 and 14. The profiles are joined to close the bag.

Thus, it will be seen that we have provided an improved bag structure and method of making which meets the objectives and advantages above set forth and provides a simple inexpensive bag which may be made of thin film with separate profile fasteners.

I claim as my invention:

1. A reclosable bag structure comprising in combination:

front and back flexible plastic film wall panels attached only their bottom and side edges and separated at the top edges to form a top filling opening;

separate first and second facing complementary pressure closable reopenable closure strips attached across the top of the inner surface of the bag wall panels;

said closure strips having interlockable rib and groove profiles on their confronting faces with said strips each having a base secured to the inner surface on the wall panel;

and at least one of the strips having a bonding element securing its base only along its upper edge to its panel at a location above the profile so that said element provides a hinge accommodating outward movement of the film panel relative to said strip without applying a direct opening force to the profile and forces on the wall panel operate in a shear rather than a peel mode on the strip;

said one strip being provided with a base which is thicker at its upper edge than the remainder of the base.

2. A reclosable bag structure comprising in combination:

front and back flexible plastic film wall panels attached along their bottom and side edges and separated at the top edges to form a top filling opening;

separate first and second facing complementary pressure closable reopenable closure strips attached across the top of the inner surface of the bag wall panels;

said closure strips having interlockable rib and groove profiles on their confronting faces with said strips each having a base secured to the inner surface of the wall panel;

at least one of the strips having a bonding element securing its base only along its upper edge to its panel at a location above the profile so that said element provides a hinge accommodating outward movement of the film panel relative to said strip without applying a direct opening force to the profile and forces on the wall panel operate in a shear rather than a peel mode on the strip;

and a layer of bonding resistant material between the panel and the base of said one strip along the lower edge of the base preventing the bonding element from attaching the lower edge of the base to the panel.

3. A reclosable bag structure constructed in accordance with claim 5:

wherein said bonding element is a heat weld.

4. A reclosable bag structure constructed in accordance with claim 2:

wherein said bonding resistant material is a silicon.

5. The method of making a reclosable bag structure comprising the steps:

providing front and back flexible plastic film wall panels attached along their bottom and side edges and separated at their top edges to form a top filling opening for a bag;

providing separate first and second complementary pressure closable reopenable closure strips and attaching said strips across the top of the bag to the inner surface of the wall panel;

said closure strips having interlockable rib and groove profiles on their confronting faces with said strips each having a base secured to the inner surface of the wall panel;

and providing a bonding element between at least one of said strips and its panel bonding the strip to its wall panel at its base only at its upper edge at a location above the profiles so that said element provides a hinge accommodating outward movement of the film panel relative to said one strip without applying a direct opening force to the profiles and forces on the wall panel operate in a shear rather than a peel mode on the strip.

6. The method of making a reclosable bag structure in accordance with the steps of claim 5:

wherein said layer is an adhesive and said one strip is bonded by the adhesive.

7. The method of making a reclosable bag structure in accordance with the steps of claim 5:

including the steps of applying bonding elements layer sand bonding both of the strips along their upper edge only to their respective panels.

8. The method of making a reclosable bag structure in accordance with the steps of claim 5:

including the step of applying an adhesive supporting material in a narrow strip along the area of an upper portion of said one strip.

9. The method of making a reclosable bag structure comprising the steps:

providing front and back flexible plastic film wall panels attached along their bottom and side edges and separated at their top edges to form a top filling opening for a bag;

providing separate first and second complementary pressure closable reopenable closure strips and attaching said strips across the top of the bag to the inner surface of the wall panel;

said closure strips having interlockable rib and groove profiles on their confronting faces with said strips each having a base secured to the inner surface of the wall panel;

and providing a bonding element between at least one of said strips and its panel bonding the strip to its wall panel at its base only at its upper edge at a location above the profiles so that said element provides a hinge accommodating outward movement of the film panel relative to said one strip without applying a direct opening force to the profiles and forces on the wall panel operate in a shear rather than a peel mode on the strip;

said one strip having a thickened portion of its base along its upper edge and said thickened portion is joined by the bonding element to the panel.

10. The method of making a reclosable bag structure comprising the steps:

providing front and back flexible plastic film wall panels attached along their bottom and side edges and separated at their top edges to form a top filling opening for a bag;

providing separate first and second complementary pressure closable reopenable plastic closure strips to the inner surface of the wall panel;

said closure strips having interlockable rib and groove profiles on their confronting faces with said strips each having a base secured to the inner surface of the wall panel;

providing a bonding element between at least one of said strips and its panel bonding the strip to its wall panel at its base only at its upper edge at a location above the profiles so that said element provides a hinge accommodating outward movement of the film panel relative to said one strip without applying a direct opening force to the profiles and forces on the wall panel operate in a shear rather than a peel mode on the strip;

and applying a bonding resistant layer of material between said one strip and the panel to which it is attached between the lower portion of the strip and the panel to prevent attachment of the lower portion of said one strip.

11. The method of making a reclosable bag structure in accordance with the steps of claim 10:

wherein said one strip is bonded by a heat bond joining the plastic of the strip to the plastic of the wall panel.

12. The method of making a reclosable bag structure in accordance with the steps of claim 10:

wherein said bonding resistant material is silicone.

* * * * *